US012808540B2

(12) United States Patent
Michenaud et al.

(10) Patent No.: US 12,808,540 B2
(45) Date of Patent: Nov. 24, 2026

(54) IGNITION DEVICES

(71) Applicants: SOCIETE BIC, Clichy (FR); BIC Violex Single Member S.A., Anoixi (GR)

(72) Inventors: Etienne Michenaud, Clichy (FR); Rene Frigiere, Clichy (FR); Dimitrios Efthimiadis, Anoixi (GR); Panagiotis Kopelas, Anoixi (GR)

(73) Assignees: SOCIETE BIC, Clichy (FR); BIC Violex Single Member S.A., Anoixi (GR)

( * ) Notice: Subject to any disclaimer, the term of this patent is extended or adjusted under 35 U.S.C. 154(b) by 349 days.

(21) Appl. No.: 18/715,508

(22) PCT Filed: Dec. 15, 2022

(86) PCT No.: PCT/EP2022/086025
§ 371 (c)(1),
(2) Date: May 31, 2024

(87) PCT Pub. No.: WO2023/111122
PCT Pub. Date: Jun. 22, 2023

(65) Prior Publication Data

US 2025/0155123 A1 May 15, 2025

(30) Foreign Application Priority Data

Dec. 15, 2021 (EP) ..... 21306776

(51) Int. Cl.
*F23Q 13/04* (2006.01)
*F23Q 2/16* (2006.01)
*F23Q 2/34* (2006.01)

(52) U.S. Cl.
CPC ..... *F23Q 13/04* (2013.01); *F23Q 2/164* (2013.01); *F23Q 2/34* (2013.01)

(58) Field of Classification Search
None
See application file for complete search history.

(56) References Cited

U.S. PATENT DOCUMENTS 4,259,059 A 3/1981 Roosa et al.
4,315,731 A 2/1982 Moore
(Continued)

FOREIGN PATENT DOCUMENTS

CN 201811276 U * 4/2011
CN 111156542 A * 5/2020 ..... F23Q 2/287
(Continued)

OTHER PUBLICATIONS

CN_111156542_A—English translation (Year: 2020).*
(Continued)

*Primary Examiner* — Jorge A Pereiro
(74) *Attorney, Agent, or Firm* — Bookoff McAndrews, PLLC

(57) ABSTRACT

The present disclosure relates to an ignition device. The ignition device comprises a flame producing assembly comprising a wand, a receiving portion configured to receive the flame producing assembly, wherein the receiving portion is configured to adapt between a receiving position and an ignition position. Further, the ignition device comprises a trigger mechanism configured to ignite the flame producing assembly when actuated. The ignition device further comprises a movable pin, wherein the movable pin is configured to move from a first position to a second position when a flame producing assembly comprising a wand is inserted into the receiving portion and the receiving portion is moved to the ignition position. The movable pin is further configured to block actuation of the trigger mechanism when in the first position, and configured to allow actuation of the trigger mechanism when in the second position.

20 Claims, 15 Drawing Sheets

(56) References Cited

U.S. PATENT DOCUMENTS

| | | | |
|---|---|---|---|
| 6,050,811 | A | 4/2000 | Stein |
| 6,217,313 | B1 | 4/2001 | Luo |
| 6,257,876 | B1 | 7/2001 | Chen |
| 6,428,309 | B1 | 8/2002 | Doiron |
| 6,488,493 | B2 | 12/2002 | Sung |
| 6,644,958 | B1 | 11/2003 | Li |
| 6,663,383 | B2 | 12/2003 | Jon |
| 2002/0094500 | A1 | 7/2002 | Tse |
| 2003/0143505 | A1 | 7/2003 | Puig-Gros |
| 2004/0063055 | A1 | 4/2004 | Yang |
| 2006/0073432 | A1 | 4/2006 | Frigiere et al. |

FOREIGN PATENT DOCUMENTS

| | | | | | |
|---|---|---|---|---|---|
| CN | 210979914 | U | | 7/2020 | |
| CN | 212408727 | U | * | 1/2021 | |
| DE | 4108701 | A1 | * | 9/1992 | ..... F23Q 13/04 |
| GB | 2416022 | A | | 1/2006 | |
| JP | S54151769 | U | | 10/1979 | |
| JP | 2003042697 | A | * | 2/2003 | |
| KR | 950007438 | Y1 | * | 9/1995 | ..... F23Q 2/00 |
| KR | 20110007010 | U | | 7/2011 | |
| KR | 1728484 | B1 | * | 4/2017 | |
| KR | 101728484 | B1 | * | 4/2017 | ..... F23Q 2/32 |
| TW | 506249 | U | * | 8/2015 | |
| TW | M506249 | U | * | 8/2015 | |
| WO | 2021056535 | A1 | | 4/2021 | |

OTHER PUBLICATIONS

Storite Pistole Shape Metal Impulse Igniter Spark Gas Lighter, Long Lasting, Rust Proof, Unbreakable, Restaurants & Kitchen Use with Cardboard Package—Silver (27cm Length) : Amazon.in: Home & Kitchen (n.d). https://www.amazon.in/dp/B014QN9NIQ/ref=sspa_dk_detail_6?pd_rd_i=B014QN9NIQ&pd_rd_w=6o84J&pf_rd_p=22b566f7-b705-4003-ab1d-17d90225e15f&pd_rd_wg=f9Tof&pf_rd_r=QNS6BYNXP89JQ2VBXT7W&pd_rd_r=b0f31d96-2a25-42ce-96f7-5c9635fa527d&spLa=ZW5jcnlwdGVkUXVhbGImaWVyPUEyMkU4UkZJRUIEUUtYJmVuY3J5cHRIZEIkPUEwNDA5OTE5.

InstaMall Plastic Flame Lighter for Kitchen Gas Stove Refillable Multicolor Pack 2□: Amazon.in: Home & Kitchen. (n.d.). https://www.amazon.in/dp/B082VTK8C9/ref=syn_sd_onsite_desktop_6?psc=1&uh_it=e443e91f99694222b108cb57bac06ffc_CT&spLa=ZW5jcnlwdGVkUXVhbGImaWVyPUEyMkU4UkZJRUIEUUtYJmVuY3J5cHRIZEIkPUEwMjE3NTI4MVpMMk1ZSVRUWkILMiZIbmNyeXB0ZWRBZEIkPUEwNTcyMDM3MkhCVkIONkVLQTFNWiZ3aWRnZXROYW1IPXNkX29uc210ZV9kZXNrdG9wJmFjdGlvbj1jbGlja1JIZGlyZWN0JmRvTm90TG9.

Amazon.in. (n.d.). https://www.amazon.in/Manoj-Sunlight-Adjustable-Lighter-Refill-High/dp/B077TV3JRN?ref_=Oct_s9_apbd_omwf_hd_bw_bAkaQ87&pf_rd_r=YZGGN4FMSB4AH50XW8EP&pf_rd_p=e2f55281-3c39-5514-8b7b-66a235c02de9&pf_rd_s=merchandised-search-10&pf_rd_t=BROWSE&pf_rd_i=9849720031.

Duraflame | Wind Resistant Flex Neck Lighter—Bendable & Lights easily in windy conditions—Duraflame. (n.d.). Duraflame. https://www.duraflame.com/products/lighters-matches/wind-resistant-utility-lighter.

International Search Report and Written Opinion issued Mar. 16, 2023 in International Application No. PCT/EP2022/086025 (12 pages).

* cited by examiner

IGNITION DEVICES

CROSS-REFERENCE TO RELATED APPLICATIONS

This application is a National Stage application of International Application No. PCT/EP2022/086025, filed on 15 Dec. 2022, now published as WO2023111122A1 and which claims benefit from European patent application EP 21306776.2 filed on 15 Dec. 2021 their contents being incorporated herein by reference.

TECHNICAL FIELD

The present disclosure relates to the field of ignition devices. More specifically, the present disclosure relates to ignition devices, comprising safety mechanisms.

BACKGROUND

Flame producing assemblies, such as lighters, are well-known everyday items. However, users employing the flame producing assemblies may risk burning themselves in the process. For example, when using a flame producing assembly where the actuation surface is placed close to the generated flame, the user may burn himself with the generated flame. In another example, when a user ignites a candle at the bottom of a container, the user may burn himself as the flame may defer upwards. Furthermore, the user may burn himself when igniting a gas stove, due to the flames produced by the gas stove. To improve the safety of flame producing assemblies and/or to improve the handling, flame producing assemblies may comprise a wand. Wands may be elongated structures protruding from the flame producing assembly. The wand is typically connected to a fuel reservoir comprised within the flame producing assembly. Further, the wand usually comprises an opening configured to release gas from the fuel reservoir, which is ignited at or close to the opening. Flame producing assemblies comprising wands are also sometimes known as utility lighters or candle lighters.

Flame producing assemblies, comprising a wand or no wand, commonly comprise ignition mechanisms configured to ignite the flame producing assembly upon actuation. The actuation may be performed by users, for example by exerting a force on an actuation surface of the ignition mechanism. To prevent accidental ignition and/or due to mechanical reasons, the exerted force commonly must exceed a certain threshold force for actuation. However, for some users, actuating the ignition mechanism may be hard as the threshold force may be too high.

To aid with actuation of the ignition mechanism, ignition devices may be used. Flame producing assemblies may be connected to or inserted into the ignition device, which may comprise a trigger mechanism, such as a lever, to facilitate actuation. Further, the ignition devices may improve the handling of the flame producing assemblies, for example by allowing to hold the flame producing assembly at a different angle or with an improved grip.

These ignition devices may have drawbacks. For example, some ignition devices are intended to be used with flame producing assemblies comprising wands, but their structure may allow the use with flame producing assemblies comprising no wands. When a flame producing assembly comprising no wand is inserted into an ignition device intended for flame producing assemblies comprising a wand, the generated flame may burn or heat the ignition device or parts thereof, which may be hazardous. Further, the ignition devices may enable children to ignite the flame producing assembles leading to potential hazards to themselves and others.

The present disclosure aims to address the aforementioned issues in improving the safety of ignition devices.

SUMMARY

In a first aspect, the following disclosure relates to an ignition device. The ignition device comprises a receiving portion configured to receive a flame producing assembly comprising a wand, wherein the receiving portion is configured to adapt between a receiving position and an ignition position. Further, the ignition device comprises a trigger mechanism configured to ignite the flame producing assembly when actuated. The ignition device further comprises a movable pin, wherein the movable pin is configured to move from a first position to a second position when a flame producing assembly comprising a wand is inserted into the receiving portion and the receiving portion is moved to the ignition position. The movable pin is further configured to block actuation of the trigger mechanism when in the first position, and the movable pin is further configured to allow actuation of the trigger mechanism when in the second position.

In embodiments, the ignition device may comprise a proximal end and a distal end, wherein the proximal end and distal end define a proximal-distal axis.

In embodiments, the ignition device may comprise a connecting structure, more specifically a connecting structure disposed along the proximal-distal axis and in particular a connecting structure connected to the movable pin at its distal end and connected to the trigger mechanism at its proximal end.

In embodiments, the connecting structure may be configured to move in proximal direction when the trigger mechanism is actuated.

In embodiments, the flame producing assembly may be inserted into the receiving portion along an insertion axis.

In embodiments, the insertion axis may be disposed substantially parallel to the proximal-distal axis when the receiving portion is in the ignition position.

In embodiments, the insertion axis may be disposed substantially perpendicular to the proximal-distal axis when the receiving portion is in the receiving position.

In embodiments, the flame producing assembly may comprise an ignition mechanism, wherein the ignition mechanism comprises an actuation surface, in particular an actuation surface disposed substantially perpendicular to the proximal-distal axis, wherein the ignition mechanism is configured to ignite the flame producing assembly upon actuation of the actuation surface.

In embodiments, the actuation surface may be actuated by being moved from a distal position towards a proximal position.

In embodiments, the flame producing assembly may be configured to release gas from a gas valve when the actuation surface is at the proximal position.

In embodiments, the ignition mechanism may comprise a restoring element, in particular a spring, configured to move the actuation surface from its proximal position to its distal position.

In embodiments, the trigger mechanism may be configured to move from a first position to a second position when actuated.

In embodiments, the trigger mechanism may comprise a pivot joint, wherein the trigger mechanism can pivot around the pivot joint from its first position to its second position.

In embodiments, the trigger mechanism may comprise a first portion, wherein the first portion may be configured to move the flame producing assembly towards the distal end when the trigger mechanism is moved, in particular pivoted, to its second position and allow the flame producing assembly to move towards the proximal end when the trigger mechanism is moved, in particular pivoted, to its first position.

In embodiments, the first portion may be configured to move towards the distal end when the trigger mechanism is actuated.

In embodiments, the trigger mechanism may comprise a second portion configured to be actuated, wherein the actuation of the second portion pivots the trigger mechanism from its first position to its second position.

In embodiments, the connecting structure may be configured to move in proximal direction when the trigger mechanism is moved from its first position to its second position and to move in distal direction when the trigger mechanism is moved from its second position to its first position.

In embodiments, the connecting structure may move towards the proximal end when the trigger mechanism is actuated.

In embodiments, trigger mechanism may be connected to a trigger restoring element, in particular a spring, configured to move the trigger mechanism into its first position.

In embodiments, the movable pin may be connected to a pin restoring element, in particular a spring, configured to move the movable pin into the first position.

In embodiments, the movable pin may be configured to interlock with the trigger mechanism or the connecting structure, when the movable pin is in its first position and to release the trigger mechanism or the connecting structure when the movable pin is in in its second position.

In embodiments, the movable pin may comprise a protrusion, in particular a protrusion configured to press against an ignition mechanism on a flame producing assembly received in the receiving portion when the trigger mechanism is actuated.

In embodiments, the movable pin may comprise the protrusion, wherein the protrusion is in a first position when the movable pin is in its first position and wherein the protrusion is in a second position when the movable pin is in its second position.

In embodiments, the protrusion may be configured to actuate the ignition mechanism, when the trigger mechanism is actuated In embodiments, the ignition device may comprise a trigger release mechanism, wherein trigger release mechanism may be configured to move from a first position to a second position when actuated.

In embodiments, the ignition device may comprise a trigger release mechanism, wherein the trigger release mechanism may be configured to move from its first position to its second position when the trigger release mechanism is actuated, and wherein the trigger release mechanism is further configured to block actuation of the trigger mechanism when in its first position, and configured to allow actuation of the trigger mechanism when in its second position.

In embodiments, the trigger release mechanism may comprise a pivot joint, wherein the trigger release mechanism can pivot around the pivot joint from its first position to its second position.

In embodiments, the trigger release mechanism may be configured to interlock with the trigger mechanism or the connecting structure connected to the trigger mechanism, when in the first position and to release the trigger mechanism or the connecting structure when in the second position.

In embodiments, the trigger release mechanism may comprise an elastic material, wherein the trigger release mechanism may be configured to move from its second position to its first position due to a restoring force exerted by the elastic material.

In embodiments, the trigger release mechanism may comprise a trigger actuation surface, configured to be actuated by a user.

In embodiments, the receiving portion may be configured to adapt between the receiving position and the ignition position by a pivotable movement.

In embodiments, the receiving portion may be a sleeve.

In embodiments, the receiving portion may comprise an opening positioned at its proximal end when in the ignition position.

In embodiments, the trigger mechanism's first portion may be positioned distally of the receiving portion's opening.

In embodiments, the trigger release mechanism may comprise a proximal end and a distal end, wherein the proximal end may comprise an actuating surface and the distal end may be configured to interlock with trigger mechanism.

In embodiments, the trigger mechanism may be positioned towards the proximal end and the movable pin is positioned towards the distal end of the ignition device.

In embodiments, the protrusion extends from the movable pin in proximal direction.

In embodiments, the ignition device may comprise an ignition device housing, wherein the trigger mechanism, receiving portion and/or movable pin are flexibly linked to the ignition device housing.

In embodiments, the connecting structure may comprise an actuating structure or may be connected to an actuating structure, more specifically the connecting structure may comprise or may be connected to an actuating structure at its distal end and in particular the actuating structure may extend from the connecting structure's distal end substantially orthogonally or orthogonally to the proximal-distal axis.

In embodiments, the actuating structure is positioned distally of the ignition mechanism, in particular distally of the ignition mechanism's actuation surface, when a flame producing assembly may be inserted in the receiving portion and the receiving portion is in the ignition position.

DETAILED DESCRIPTION

Hereinafter, a detailed description will be given of the present disclosure. The terms or words used in the description and the aspects of the present disclosure are not to be construed limitedly as only having common-language or dictionary meanings and should, unless specifically defined otherwise in the following description, be interpreted as having their ordinary technical meaning as established in the relevant technical field. The detailed description will refer to specific embodiments to better illustrate the present disclosure, however, it should be understood that the presented disclosure is not limited to these specific embodiments.

Flame producing assemblies may be difficult to ignite for some users, as they may not be able to exert sufficient pressure on the flame producing assembly's ignition mechanism. To facilitate the ignition of flame producing assemblies, ignition devices may be used. However, ignition devices intended for use with flame producing assemblies comprising a wand may be damaged or pose a hazard when used with flame producing assemblies without a wand.

Accordingly, in a first aspect, the present disclosure relates to an ignition device configured to ignite a flame producing assembly. The ignition device comprises a receiving portion configured to receive a flame producing assembly, wherein the receiving contraption is configured to adapt between a receiving position and an ignition position. Further, the ignition device comprises a trigger mechanism configured to ignite the flame producing assembly when actuated. The ignition device further comprises a movable pin, wherein the movable pin is configured to move from a first position to a second position when a flame producing assembly comprising a wand is inserted into the receiving portion and the receiving portion is moved to the ignition position. The movable pin is further configured to block actuation of the trigger mechanism when in the first position and configured to allow actuation of the trigger mechanism when in the second position.

An ignition device as described above may facilitate the ignition of a flame producing assembly comprising a wand. Further, an ignition device as described above may prevent ignition of flame producing assemblies without a wand inserted in the ignition device.

DESCRIPTION OF THE FIGURES

Figure 1A:
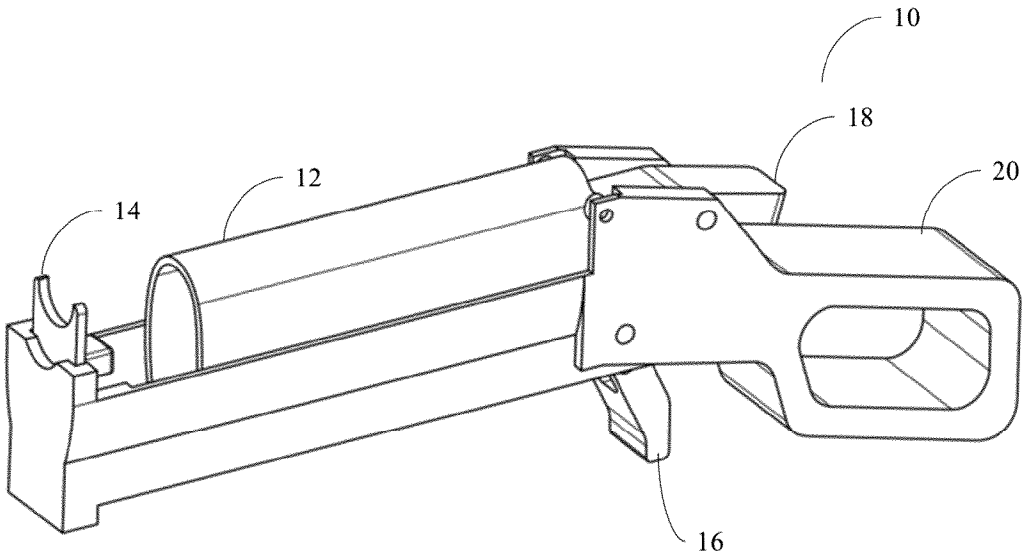
FIG. 1A is an isometric perspective of a first exemplary embodiment of an ignition device.
Figure 1B:
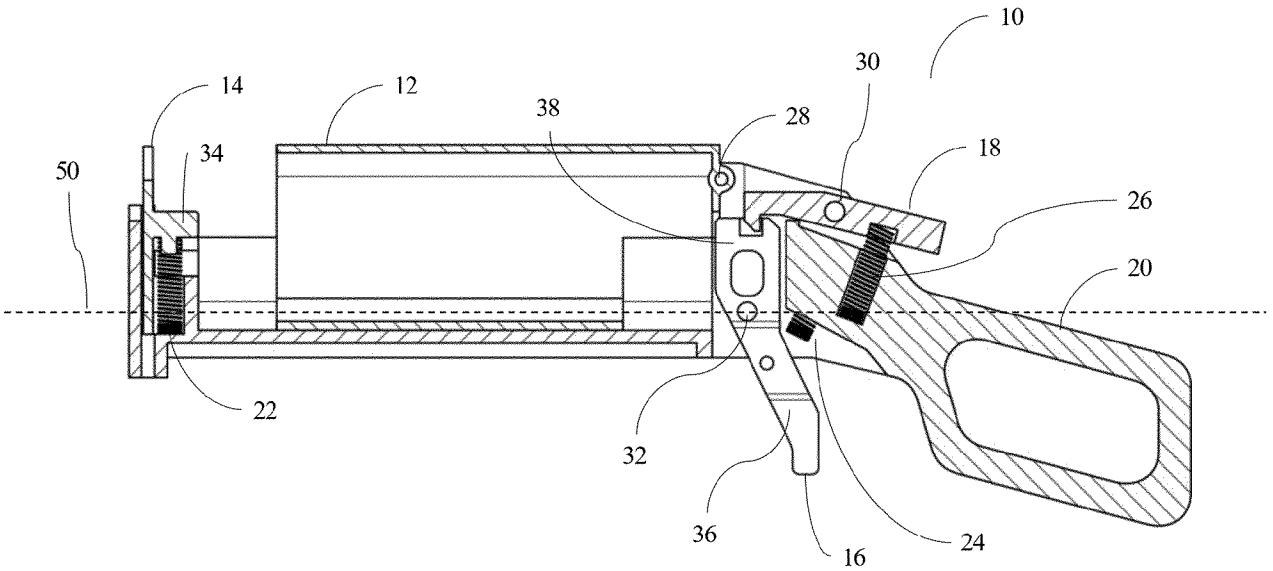
FIG. 1B shows a section-view of the first exemplary embodiment without an ignition device received in the receiving portion.

FIG. 1A, FIG. 1B, FIG. 1C, FIG. 1D, FIG. 1E and FIG. 1F show a first exemplary embodiment of an ignition device 10 according to the first aspect. FIG. 1A is an isometric view of the ignition device 10 according to the first exemplary embodiment. FIG. 1B shows the first exemplary embodiment of the ignition device 10 without a flame assembly inserted. The receiving portion 12 is in the ignition position. The receiving portion 12 can be pivoted into the receiving position around a pivot joint 28. The trigger mechanism 16 can be actuated to pivot around a pivot joint 32 from a first position to a second position. The trigger mechanism 16 is a lever. In examples, the trigger may also be a pusher or a press-button. A restoring element 24, depicted as a spring, may pivot the trigger mechanism 16 back to the first position after the trigger mechanism 16 has been pivoted into the second position. In FIG. 1B the trigger mechanism is in its first position. The movable pin 14 is also in its first position.

FIG. 1B further shows a proximal-distal axis 50. In FIG. 1B, the movable pin 14 is disposed closer towards the distal end of the proximal-distal axis 50 and the trigger mechanism is disposed closer to the proximal end of the proximal-distal axis 50. The movable pin 14 comprises a protrusion 34. The movable pin 14 is connected to a restoring element 22, depicted as a spring, which may move the movable pin 14 back to its first position after it has been moved into its second position. The movable pin 14 may comprise a receiving end, in particular a receiving end configured to receive a wand. The receiving end may for example have the complement form of the wand or part thereof. For example, if the wand to be received has a circular shape, the receiving end may have the form of a circle segment.

FIG. 1B further shows a trigger release mechanism 18. The trigger release mechanism 18 is a lever. The trigger release mechanism 18 may be pivoted around the pivot joint 30 from a first to a second position. The restoring element 26 may return the trigger release mechanism 18 from the second position to its first position. The trigger release mechanism 18 may block the actuation of the trigger mechanism 16. For example, as is shown in FIG. 1B, a protrusion on the trigger release mechanism 18 may interlock with a recess in the trigger mechanism 16, in particular in the first portion 38 of the trigger mechanism 16. The trigger release mechanism 18 may provide additional safety. In particular, the trigger release mechanism 18 requires a two-step actuation process. The two-step actuation process may be significantly more complicated, in particular for children, hence reducing the probability of unintentional ignition and/or ignition by a child.

The ignition device 10 may further comprise a handle 20. The handle 20 may be used by a user to grip the device. The handle 20 may comprise a hole, wherein a user may insert for example a finger.

Figure 1C:
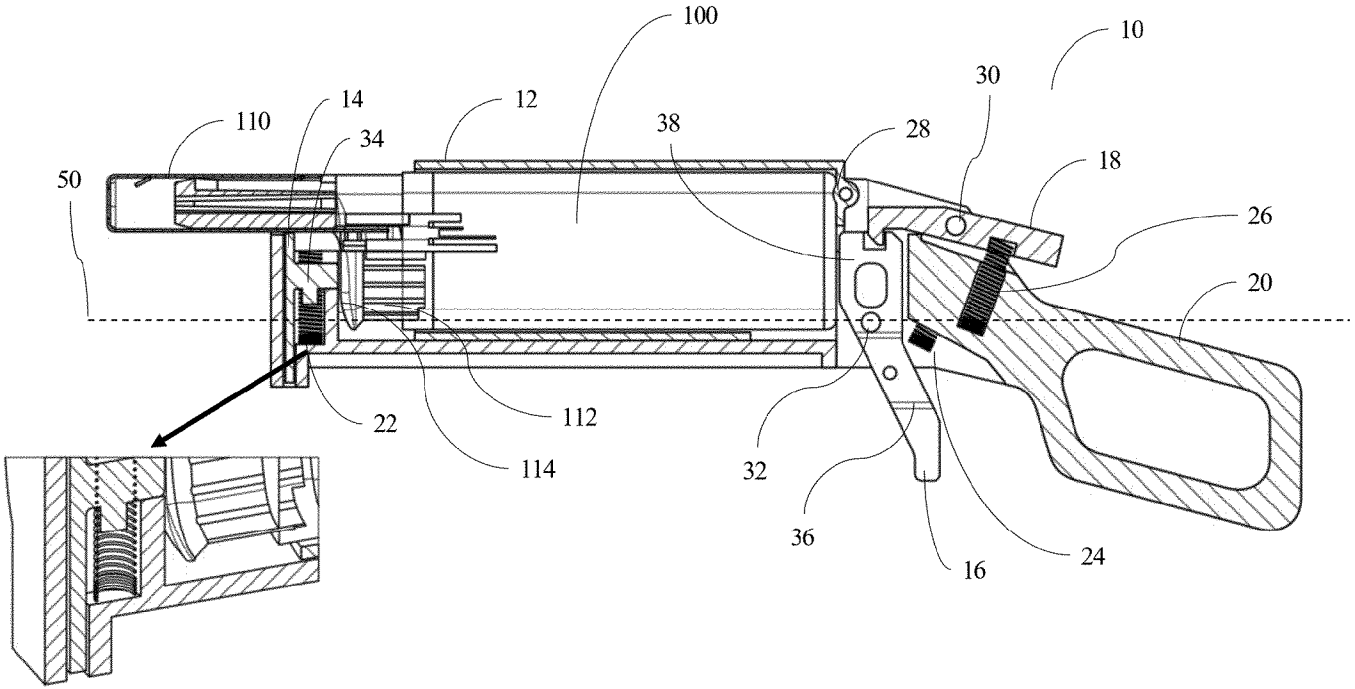
FIG. 1C shows a section-view of the first exemplary embodiment with an ignition device comprising a wand received in the receiving portion.

FIG. 1C shows the ignition device 10 of FIG. 1A with a flame producing assembly 100 received in the receiving portion 12. The flame producing assembly 100 comprises a wand 110. The flame producing assembly 100 further comprises an ignition mechanism 112 comprising an actuation surface 114. As is shown, the reception of a flame producing assembly 100 comprising a wand 110 has moved the movable pin 14 into its second position. For example, the flame producing assembly 100 may have been inserted into the receiving portion 12 in the receiving position not depicted.

The receiving portion may have then been pivoted around the pivot joint 28 into the ignition position as depicted. During the pivotal movement the wand 110 may have pressed on the top of the movable pin 14 moving it from its first position to its second position. The ignition device 10 may comprise a releasable locking mechanism not depicted to lock the receiving portion 12, as otherwise the movable pin 14 may move the receiving portion 12 out of the ignition position, in particular due to forces exerted on the movable pin 14 by the restoring element 22.

Figure 1D:
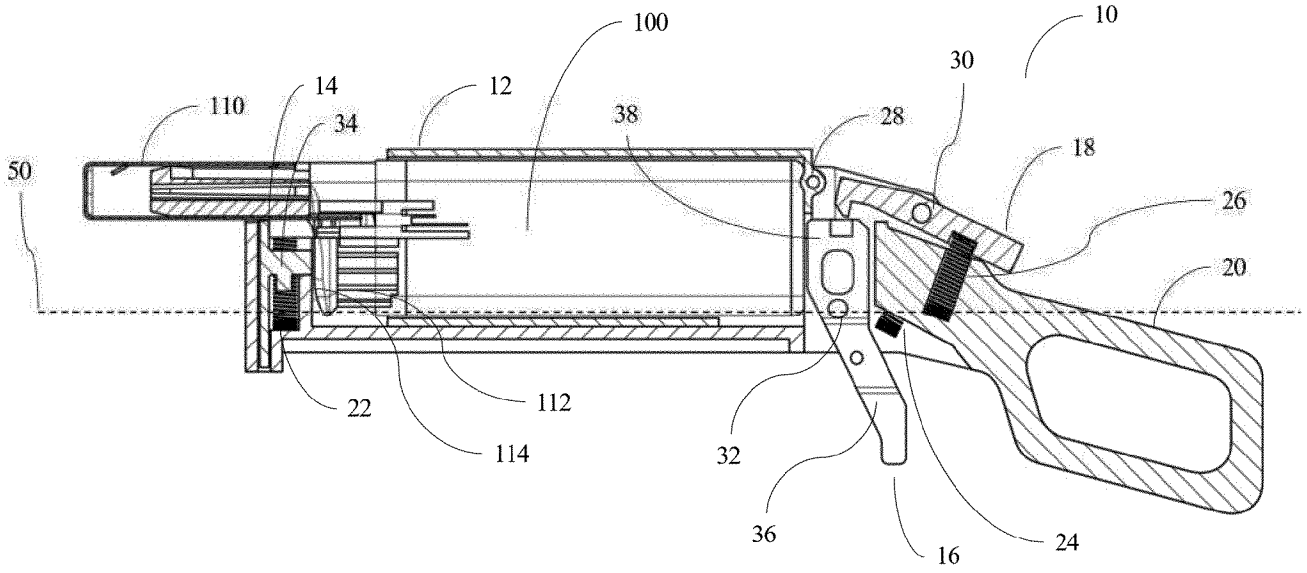
FIG. 1D shows a section-view of the first exemplary embodiment wherein the trigger release mechanism is actuated.

FIG. 1D shows the ignition device 10 of FIG. 1C with a flame producing assembly 100 received in the receiving portion 12. In FIG. 1D the trigger release mechanism 18 has been pivoted about the pivot joint 30 from its first to its second position. As a result, the trigger mechanism 16 is not interlocked with the trigger release mechanism 18 anymore and hence may be actuated.

Figure 1E:
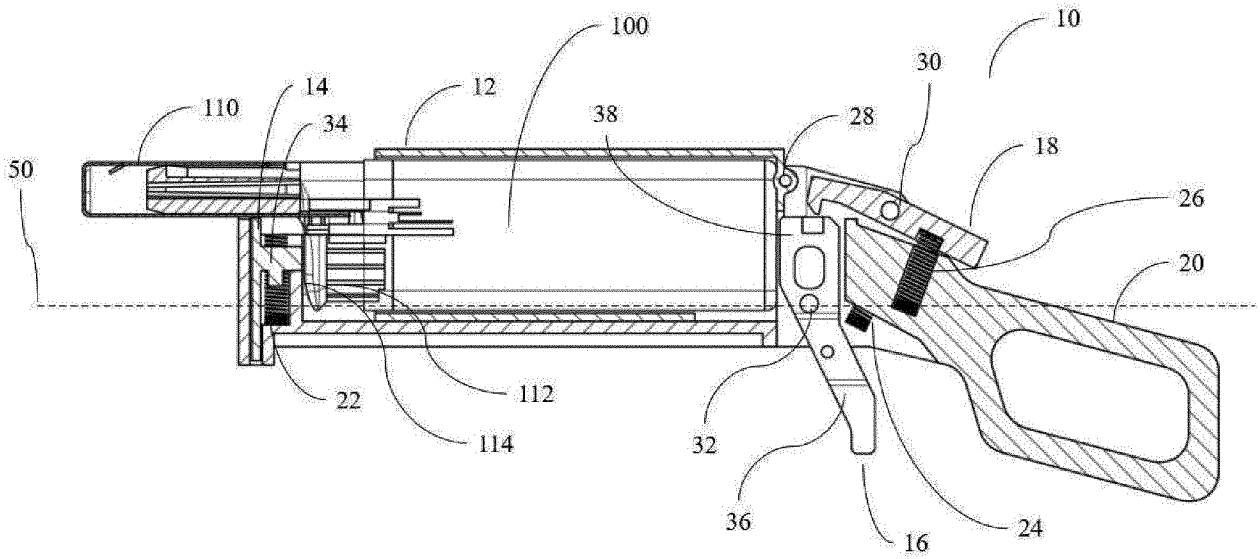
FIG. 1E shows a section-view of the first exemplary embodiment wherein the trigger mechanism is actuated.

FIG. 1E shows the ignition device 10 of FIG. 1D after actuation of the trigger mechanism 16. The trigger mechanism 16 has pivoted around the pivot joint 32. For example, a user may have exerted force on a second portion 36 of the trigger mechanism 16, whereby the second portion 36 has moved towards the ignition device's 10 proximal end. Meanwhile, a first portion 38 of the trigger mechanism 16 has moved towards the distal end. Due to the movement of the first portion 38 towards the distal end, the flame producing assembly 100 is also moved towards the distal end. The receiving portion 12 may comprise an opening at its proximal end to allow the first portion 38 to contact the flame producing assembly 100. The actuation surface 114 is moved towards the flame producing assembly's 100 proximal end. In particular, the actuation surface 114 cannot move in distal direction due to the protrusion 34, while the rest of the flame producing assembly 100 moves towards the distal end. The movement of the actuation surface 114 towards the flame producing assembly's 100 proximal end may actuate the ignition mechanism 112. The actuation of the ignition mechanism 112 may lead the flame producing assembly to release gas, or another type of fuel, in particular into the wand 110. Further, the actuation of the ignition mechanism 112 may lead to the ignition of the gas in the wand, thus generating a flame at the distal end of the flame producing assembly's 100 wand 110. To ignite the gas the wand may comprise for example a spark generator, which generates a spark when the ignition mechanism 112 is actuated. The flame producing assembly 100 may comprise a restoring element, in particular the ignition mechanism 112 may comprise a restoring element configured to move the actuation surface 114 from its proximal position to its distal position. The movement of the actuation surface 114 from its proximal position to its distal position may also return the flame producing assembly 100 to its initial position. The initial position may be the position the flame producing assembly 100 was in before actuation of the trigger mechanism 16.

Figure 1F:
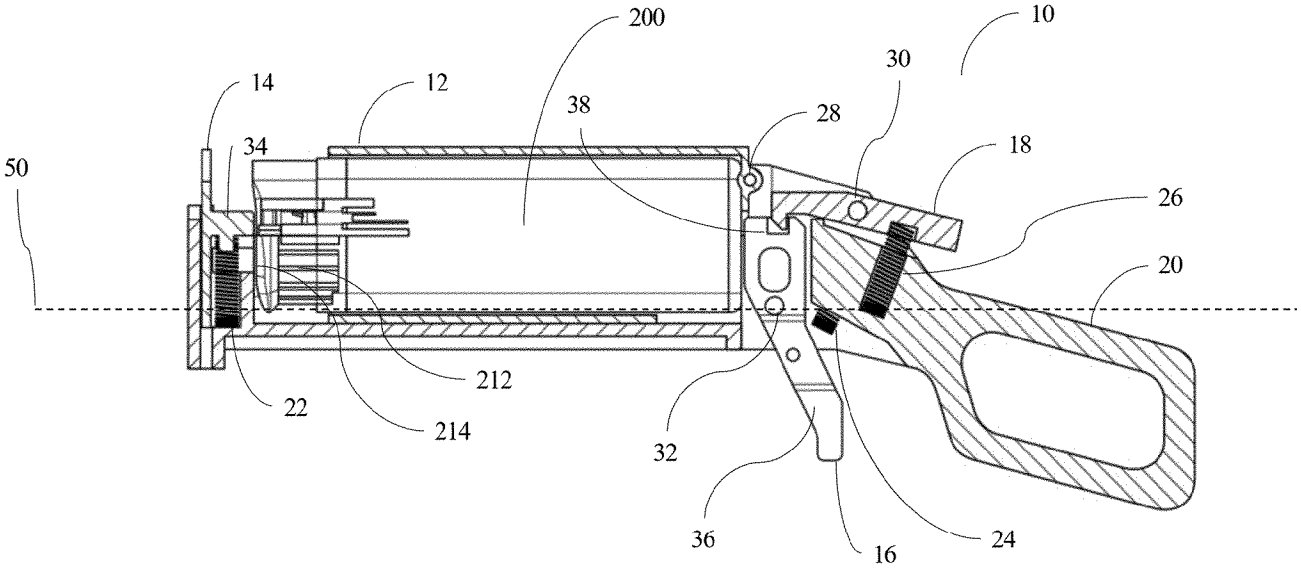
FIG. 1F shows a section-view of the first exemplary embodiment wherein an ignition device without a wand is received.

FIG. 1F shows the ignition device 10 with a flame producing assembly 200 received in the receiving portion 12 which does not comprise a wand. As depicted, the protrusion 34 is not disposed adjacent to the flame producing assembly's 200 actuation surface 214. As a result, even if the trigger release mechanism 18 would be in the second position, the trigger mechanism 16 could not be moved into its second position as the movement of the flame producing assembly 200 would be blocked by the protrusion 34.

Figure 2A:
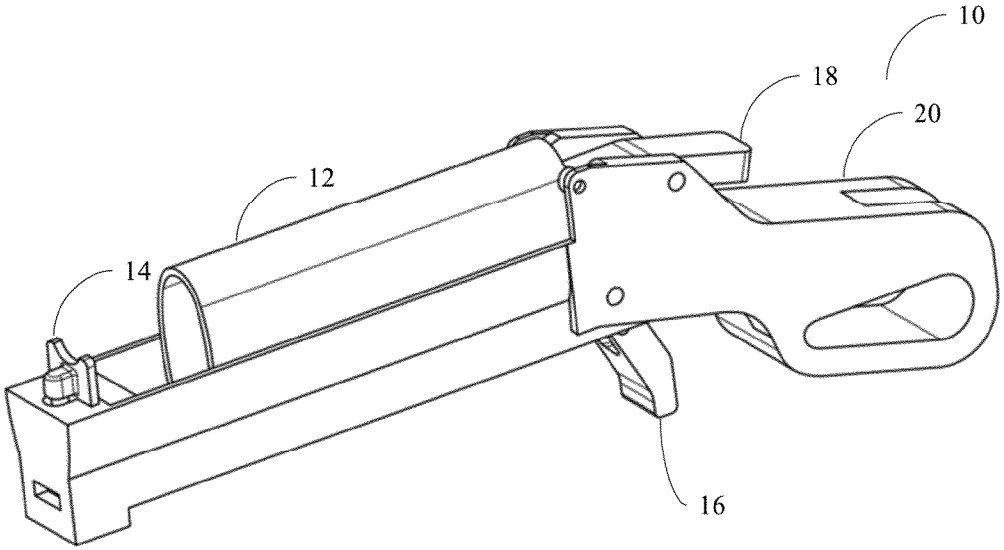
FIG. 2A is an isometric perspective of a second exemplary embodiment of an ignition device.
Figure 2B:
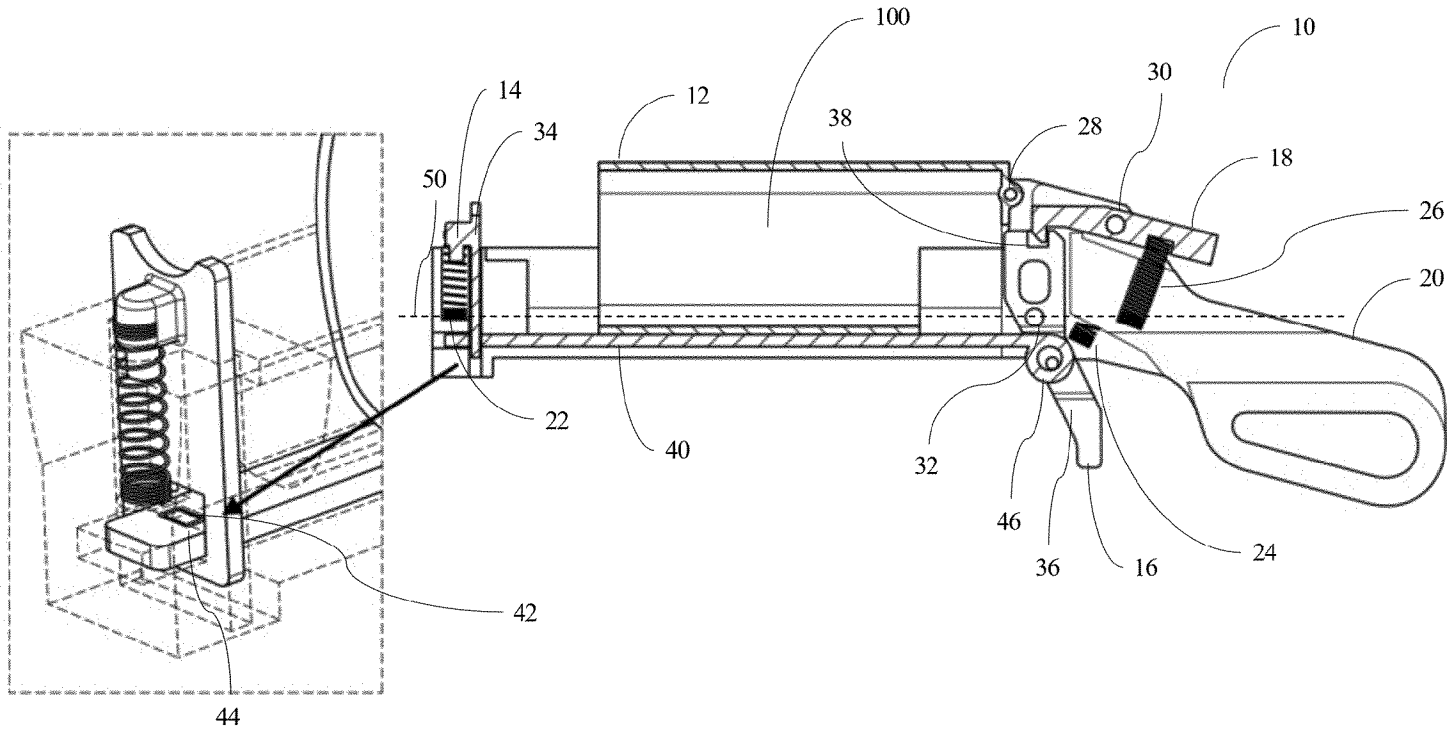
FIG. 2B shows a section-view of the second exemplary embodiment without an ignition device received in the receiving portion.

FIG. 2A, 2B, 2C, 2D show a second exemplary embodiment of an ignition device 10 according to the first aspect. FIG. 2A is an isometric view of the second exemplary embodiment. FIG. 2B shows that the protrusion 34 is interlocked with a connecting structure 40 connected to the second portion 36 of the trigger mechanism 16 at an interconnection 46. The interlock prevents actuation of the trigger mechanism 16 as long as the movable pin 14 is in the first position. The interlock may comprise an interlocking protrusion 42 comprised in the protrusion 34 and a complement recess 44 comprised in the connecting structure 40.

Figure 2C:
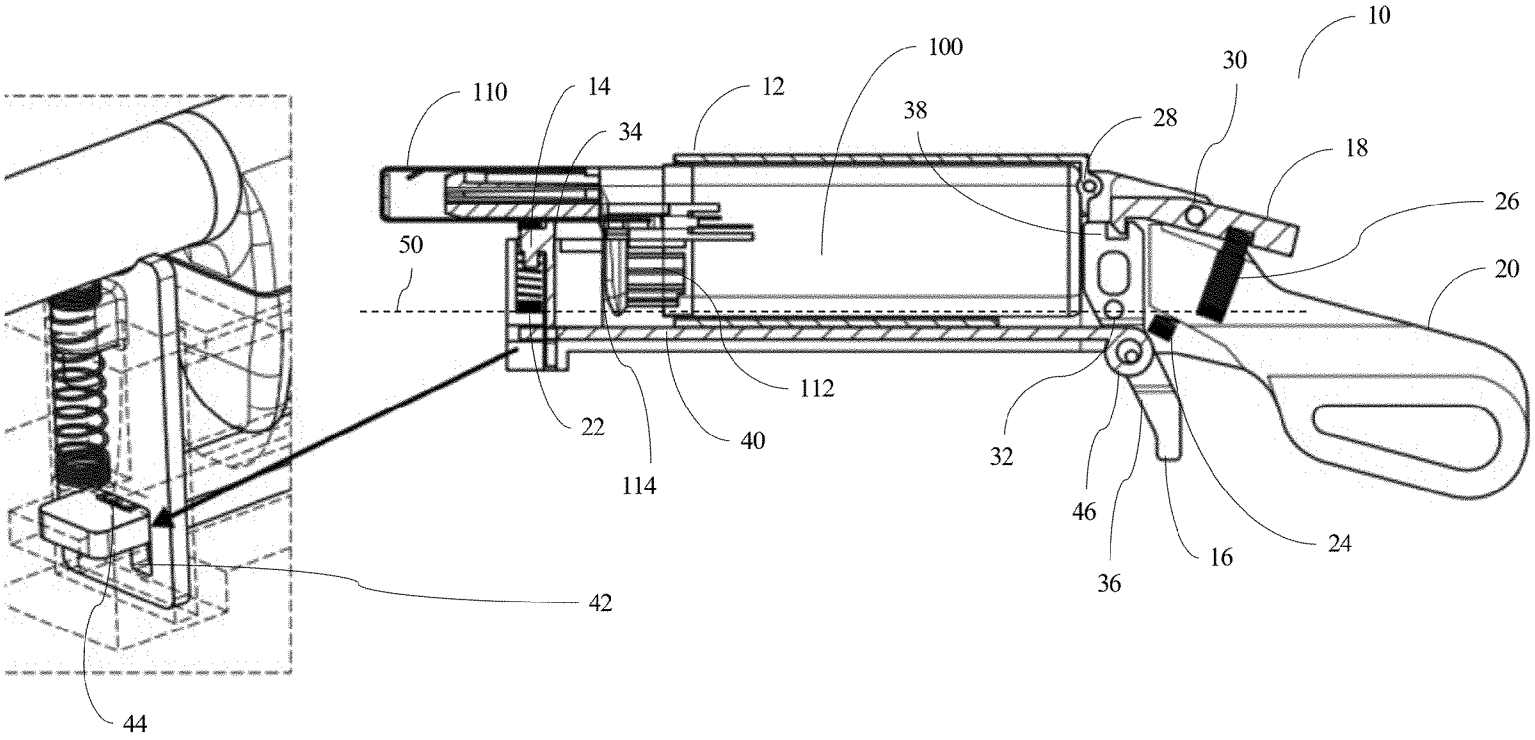
FIG. 2C shows a section-view of the second exemplary embodiment with an ignition device comprising a wand received in the receiving portion.

FIG. 2C shows that after reception of a flame producing assembly 100 comprising a wand 112 the movable pin 14 moves to the second position, thereby moving the interlocking protrusion 42 out of the complement recess 44. This may allow moving the connecting structure 40 relative to the movable pin 14, hence allowing actuation of the trigger mechanism 16. If a flame producing assembly 200 without a wand would be received in the ignition device 10 the interlock of the protrusion 34 and the connecting structure 40 would not be released, thereby preventing ignition of the flame producing assembly 200.

Figure 2D:
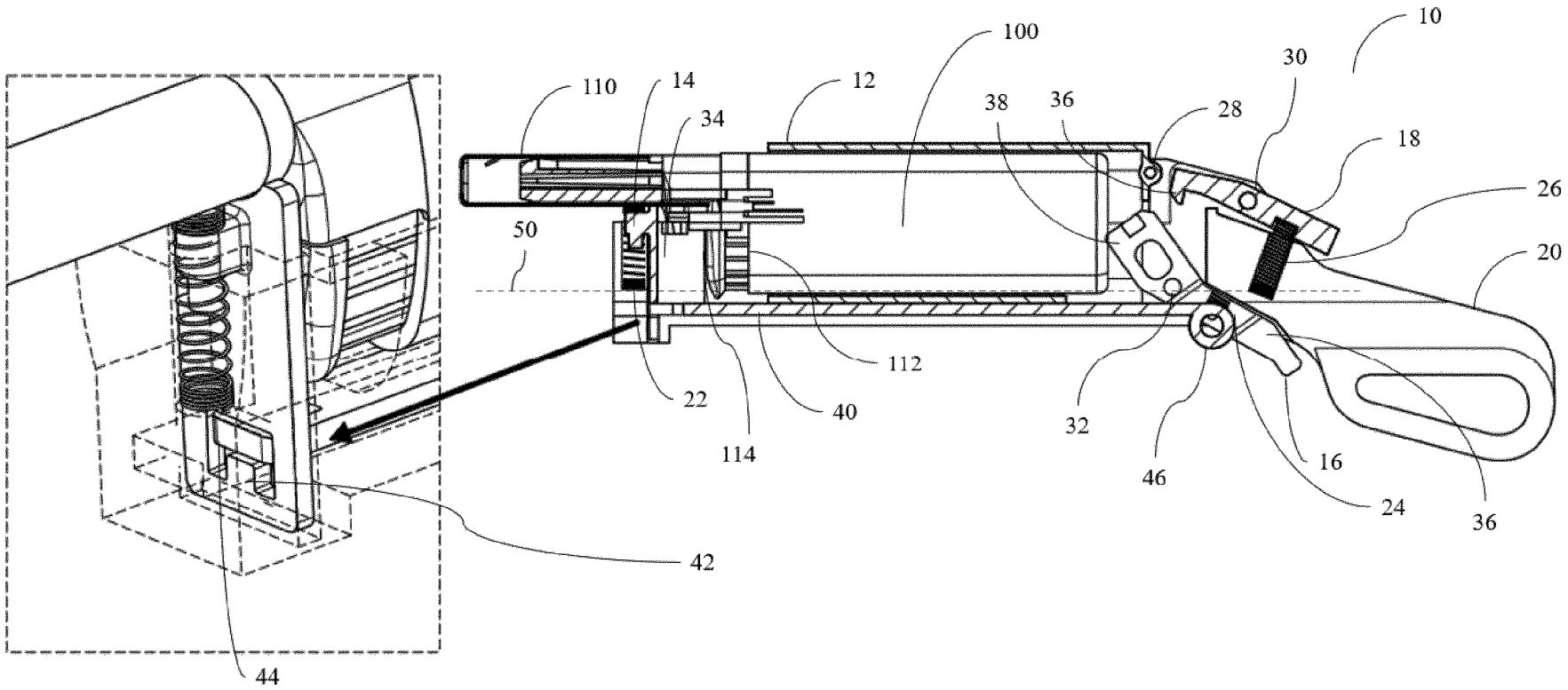
FIG. 2D shows a section-view of the second exemplary embodiment wherein the trigger mechanism is actuated.

FIG. 2D shows the ignition device 10 of FIG. 2C after actuation of the trigger mechanism 16. Prior to the actuation the trigger release mechanism 18 has been pivoted to its second position. The first portion 38 of the trigger mechanism 16 has moved towards the distal end. Due to the movement of the first portion 38 towards the distal end, the flame producing assembly 100 has also moved towards the distal end. The actuation surface 114 cannot move in distal direction due to the protrusion 34, while the rest of the flame producing assembly 100 moves towards the distal end, thus again leading to actuation of the ignition mechanism 112.

Figure 3A:
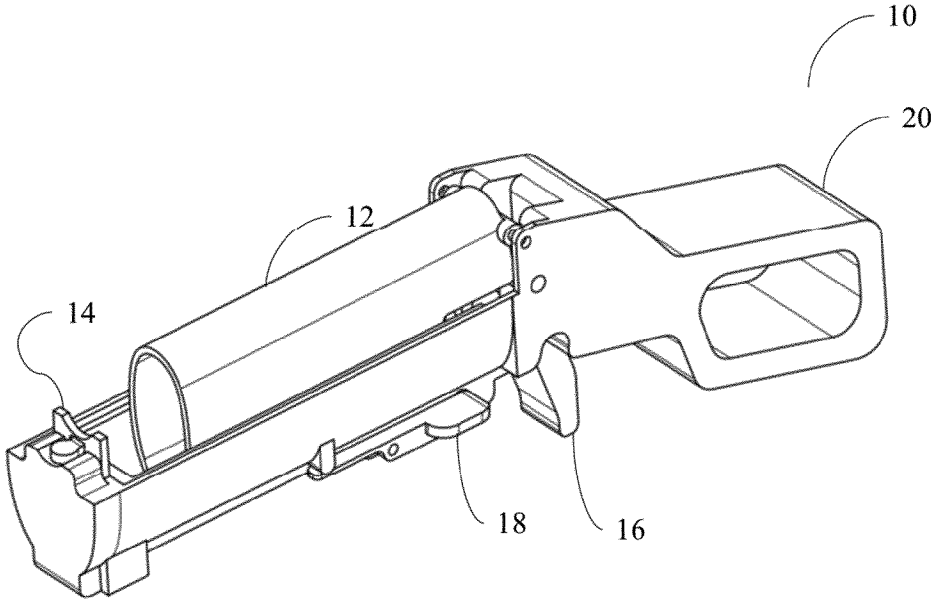
FIG. 3A is an isometric perspective of a third exemplary embodiment of an ignition device.
Figure 3B:
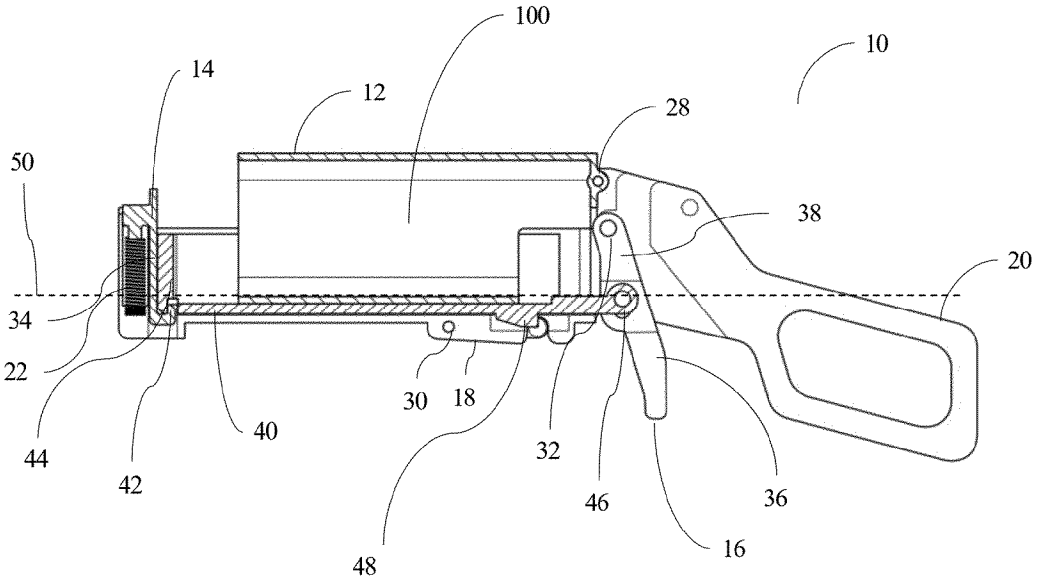
FIG. 3B shows a section-view of the third exemplary embodiment without an ignition device received in the receiving portion.
Figure 3C:
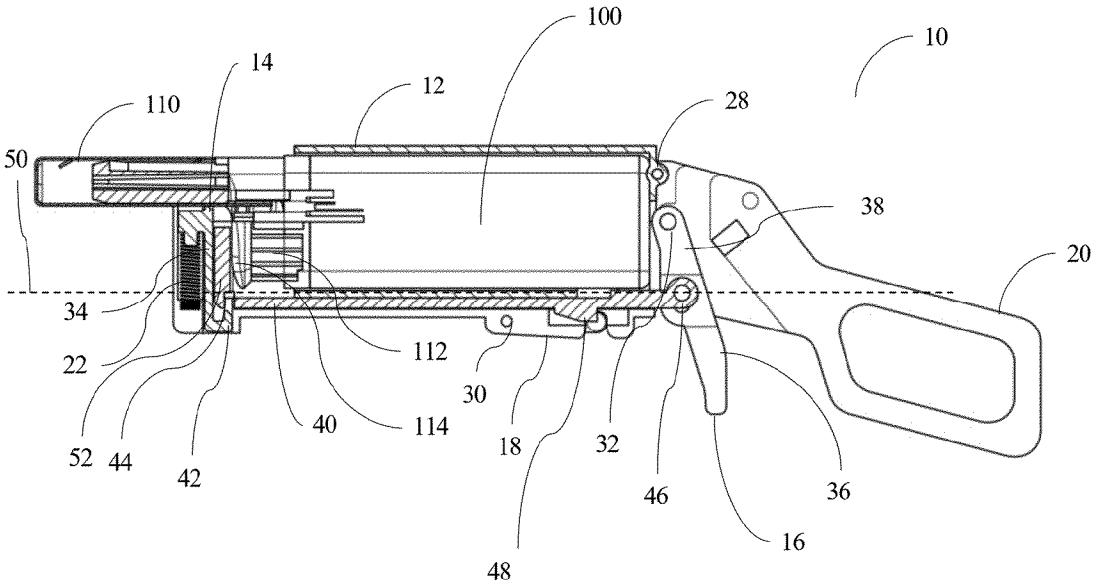
FIG. 3C shows a section-view of the third exemplary embodiment with an ignition device comprising a wand received in the receiving portion.

FIGS. 3A, 3B, 3C and 3D show a third exemplary embodiment of an ignition device 10 according to the first aspect. Herein the trigger release mechanism 18 releasably interlocks with the interconnecting structure 40. In particular, as depicted in FIGS. 3A, 3B, 3C and 3D the connecting structure 40 may comprise a connecting structure protrusion 48, which may interlock with the trigger release mechanism 18. The trigger release mechanism 18 depicted in FIGS. 3A, 3B, 3C, and 3D may not comprise a restoring element 26. Instead, the trigger release mechanism 18 according to the third exemplary embodiment of the ignition device 10 may be elastic and return from its second position to its first position due to its material's restoring force, for example the trigger release mechanism 18 may be manufactured from an elastomer. The connecting structure 40 may again releasably interlock with the movable pin 14, when the movable pin 14 is in the first position. Due to the interconnection 46 the trigger mechanism 16 may not be actuated when the movable pin 14 is in the first position. Further, the interlock of the connecting structure 40 and the movable pin 14 may again be released when the movable pin 14 moves to the second position, as depicted in FIG. 3C, for example when a flame producing assembly 100 comprising a wand 110 is received in the ignition device 10, more specifically in the receiving portion 12. The interlock may comprise an interlocking protrusion 42, in particular a hook-shaped protrusion, comprised in the protrusion 34 and a complement recess 44 comprised in the connecting structure 40. The connecting structure 40 comprises an actuating structure 52 configured to move towards the proximal direction, when the trigger mechanism 16 is actuated. In particular, the actuating structure 52 may be configured to actuate the flame producing assemblies 100 ignition mechanism 112 by moving the actuation surface 114 in proximal direction, when the trigger mechanism 16 is actuated.

Figure 3D:
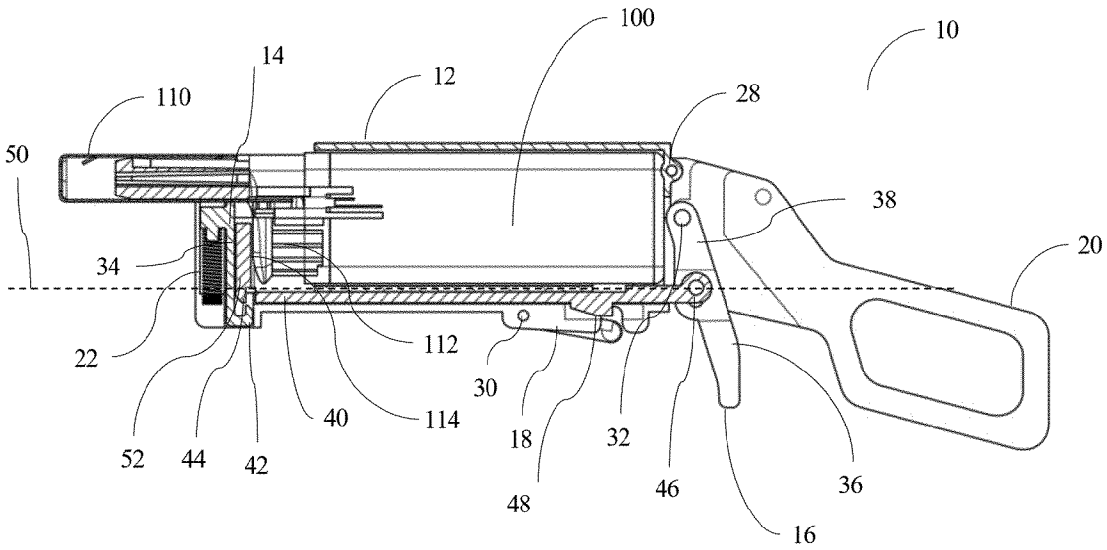
FIG. 3D shows a section-view of the third exemplary embodiment wherein the trigger release mechanism is actuated.

FIG. 3C shows that after reception of a flame producing assembly 100 comprising a wand 112 the movable pin 14 moves to the second position, thereby moving the interlocking protrusion 42 out of the complement recess 44. This may allow moving the connecting structure 40 relative to the movable pin 14, hence allowing actuation of the trigger mechanism 16. If a flame producing assembly 200 without a wand would be received in the ignition device 10 the interlock of the protrusion 34 and the connecting structure 40 would not be released, thereby preventing ignition of the flame producing assembly 200. FIG. 3D also shows that the trigger release mechanism 18 is moved away from the connecting structure protrusion 48, thereby releasing the interlock thereto.

Figure 3E:
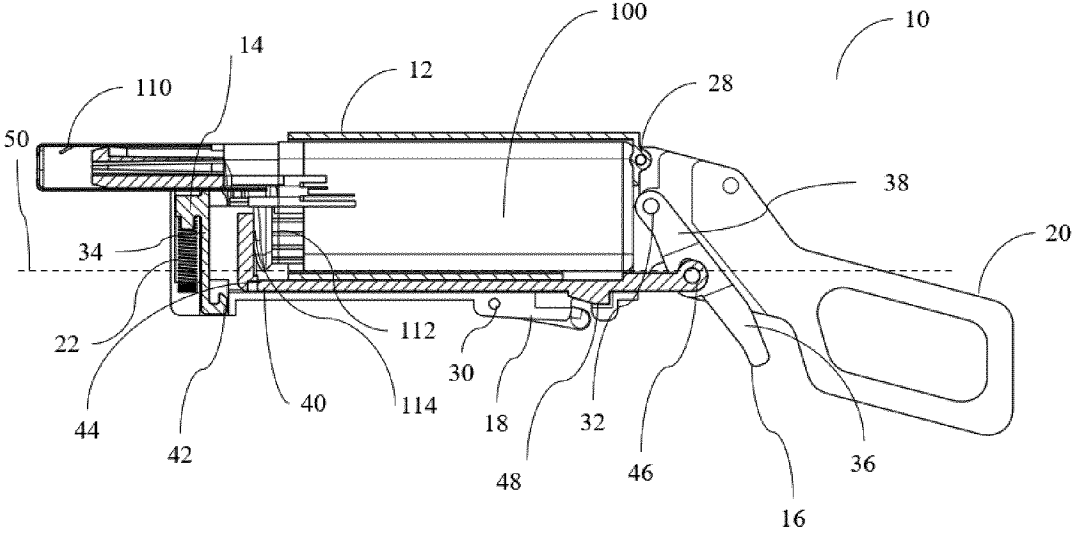
FIG. 3E shows a section-view of the third exemplary embodiment wherein the trigger mechanism is actuated.

FIG. 3D shows that the pivot joint 32 may be positioned on the first portion 38 of the trigger mechanism 16. As a result, when actuated the trigger mechanism's 16 first portion 38 does not move in distal direction. However, the interconnection 46 was moved in proximal direction by the actuation of the trigger mechanism 16, thereby moving the connecting structure 40 towards the proximal end. Due to the connecting structure moving proximally, the actuating structure 52 moved proximally against the actuating surface 114, in turn actuating the ignition mechanism 112, as shown in FIG. 3E.

In a first aspect, the following disclosure relates to an ignition device 10 configured to ignite a flame producing assembly 100 comprising a wand 110. The ignition device comprises a receiving portion 12 configured to receive a flame producing assembly 100, wherein the receiving portion 12 is configured to adapt between a receiving position and an ignition position. Further, the ignition device 10 comprises a trigger mechanism 16 configured to ignite the flame producing assembly 100 when actuated. The ignition device 10 further comprises a movable pin 14, wherein the movable pin 14 is configured to move from a first position to a second position when a flame producing assembly 100 is inserted into the receiving portion 12 and the receiving portion 12 is moved to the ignition position. The movable pin 14 is further configured to block actuation of the trigger mechanism 16 when in the first position, and configured to allow actuation of the trigger mechanism 16 when in the second position.

In embodiments, the ignition device 10 may comprise a proximal end and a distal end, wherein the proximal end and distal end define a proximal-distal axis 50.

In embodiments, the ignition device 10 may comprise a connecting structure 40, more specifically a connecting structure 40 disposed along the proximal-distal axis 50 and in particular a connecting structure 40 connected to the movable pin 14 at its distal end and connected to the trigger mechanism 16 at its proximal end.

In embodiments, the connecting structure 40 may be configured to move in proximal direction when the trigger mechanism 16 is actuated.

In embodiments, the flame producing assembly 100 may be inserted into the receiving portion 12 along an insertion axis.

In embodiments, the insertion axis may be disposed substantially parallel to the proximal-distal axis 50 when the receiving portion 12 is in the ignition position.

In embodiments, the insertion axis may be disposed substantially perpendicular to the proximal-distal axis 50 when the receiving portion 12 is in the receiving position.

In embodiments, the flame producing assembly 100 may comprise an ignition mechanism 112, wherein the ignition mechanism 112 comprises an actuation surface 114, in particular an actuation surface 114 disposed substantially perpendicular to the proximal-distal axis 50, wherein the ignition mechanism 112 is configured to ignite the flame producing assembly 100 upon actuation of the actuation surface 114.

In embodiments, the actuation surface 114 may be actuated by being moved from a distal position towards a proximal position.

In embodiments, the flame producing assembly 100 may be configured to release gas from a gas valve when the actuation surface 114 is at the proximal position.

In embodiments, the ignition mechanism 112 may comprise a restoring element, in particular a spring, configured to move the actuation surface 114 from its proximal position to its distal position.

In embodiments, the trigger mechanism 16 may be configured to move from a first position to a second position when actuated.

In embodiments, the trigger mechanism 16 may comprise a pivot joint 32, wherein the trigger mechanism 16 can pivot around the pivot joint 32 from its first position to its second position.

In embodiments, the trigger mechanism 16 may comprise a first portion 38, wherein the first portion 38 may be configured to move the flame producing assembly 100 towards the distal end when the trigger mechanism 16 is moved, in particular pivoted, to its second position and allow the flame producing assembly 100 to move towards the proximal end when the trigger mechanism 16 is moved, in particular pivoted, to its first position.

In embodiments, the first portion 38 may be configured to move towards the distal end when the trigger mechanism 16 is actuated.

In embodiments, the trigger mechanism 16 may comprise a second portion 36 configured to be actuated, wherein the actuation of the second portion 36 pivots the trigger mechanism 16 from its first position to its second position.

In embodiments, the connecting structure 40 may be configured to move in proximal direction when the trigger mechanism 16 is moved from its first position to its second position and to move in distal direction when the trigger mechanism 16 is moved from its second position to its first position.

In embodiments, the connecting structure 40 may move towards the proximal end when the trigger mechanism 16 is actuated.

In embodiments, trigger mechanism 16 may be connected to a trigger restoring element 24, in particular a spring, configured to move the trigger mechanism 16 into its first position.

In embodiments, the movable pin 14 may be connected to a pin restoring element 22, in particular a spring, configured to move the movable pin 14 into the first position.

In embodiments, the movable pin 14 may be configured to interlock with the trigger mechanism 16 or the connecting structure 40, when the movable pin 14 is in its first position and to release the trigger mechanism 16 or the connecting structure 40 when the movable pin 14 is in in its second position.

In embodiments, the movable pin 14 may comprise a protrusion 34, in particular a protrusion 34 configured to press against an ignition mechanism 112 on a flame producing assembly 100 received in the receiving portion 12 when the trigger mechanism 16 is actuated.

In embodiments, the movable pin 14 may comprise the protrusion 34, wherein the protrusion 34 is in a first position when the movable pin 14 is in its first position and wherein the protrusion 34 is in a second position when the movable pin 14 is in its second position.

In embodiments, the protrusion 34 may be configured to actuate the ignition mechanism 112, when the trigger mechanism 16 is actuated In embodiments, the ignition device 10 may comprise a trigger release mechanism 18, wherein trigger release mechanism 18 may be configured to move from a first position to a second position when actuated.

In embodiments, the ignition device 10 may comprise a trigger release mechanism 18, wherein the trigger release mechanism 18 may be configured to move from its first position to its second position when the trigger release mechanism 18 is actuated, and wherein the trigger release mechanism 18 is further configured to block actuation of the trigger mechanism 16 when in its first position, and configured to allow actuation of the trigger mechanism 16 when in its second position.

In embodiments, the trigger release mechanism 18 may comprise a pivot joint 30, wherein the trigger release mechanism 18 can pivot around the pivot joint 30 from its first position to its second position.

In embodiments, the trigger release mechanism 18 may be configured to interlock with the trigger mechanism 16 or the connecting structure 40 connected to the trigger mechanism 16, when in the first position and to release the trigger mechanism 16 or the connecting structure 40 when in the second position.

In embodiments, the trigger release mechanism 18 may comprise an elastic material, wherein the trigger release mechanism 18 may be configured to move from its second position to its first position due to a restoring force exerted by the elastic material.

In embodiments, the trigger release mechanism 18 may comprise a trigger actuation surface, configured to be actuated by a user.

In embodiments, the receiving portion 12 may be configured to adapt between the receiving position and the ignition position by a pivotable movement.

In embodiments, the receiving portion 12 may be a sleeve.

In embodiments, the receiving portion 12 may comprise an opening positioned at its proximal end when in the ignition position.

In embodiments, the trigger mechanism's 16 first portion 38 may be positioned distally of the receiving portion's 12 opening.

In embodiments, the trigger release mechanism 18 may comprise a proximal end and a distal end, wherein the proximal end may comprise an actuating surface and the distal end may be configured to interlock with trigger mechanism 16.

In embodiments, the trigger mechanism 16 may be positioned towards the proximal end and the movable pin 14 is positioned towards the distal end of the ignition device 10.

In embodiments, the protrusion 34 extends from the movable pin 14 in proximal direction.

In embodiments, the ignition device 10 may comprise an ignition device housing, wherein the trigger mechanism 16, receiving portion 12 and/or movable pin 14 are flexibly linked to the ignition device housing.

In embodiments, the connecting structure 40 may comprise an actuating structure 44 or may be connected to an actuating structure 44, more specifically the connecting structure 40 may comprises or may be connected to an actuating structure 44 at its distal end and in particular the actuating structure 44 may extend from the connecting structure's 40 distal end substantially orthogonally or orthogonally to the proximal-distal axis 50.

In embodiments, the actuating structure 44 is positioned distally of the ignition mechanism 112, in particular distally of the ignition mechanism's 112 actuation surface 114, when a flame producing assembly 100 may be inserted in the receiving portion 12 and the receiving portion 12 is in the ignition position.

ASPECTS

1. In a first aspect the present disclosure relates to an ignition device (10) configured to ignite
   - a flame producing assembly (100), comprising:
     - a receiving portion (12) configured to receive a flame producing assembly (100), wherein the receiving portion (12) is configured to adapt between a receiving position and an ignition position;
     - a trigger mechanism (16) configured to ignite the flame producing assembly (100) when actuated;
     - a movable pin (14), wherein the movable pin (14) is configured to move from a first position to a second position when a flame producing assembly (100) comprising a wand (110) is inserted into the receiving portion (12) and the receiving portion (12) is moved to the ignition position,
     - and wherein the movable pin (14) is further configured to block actuation of the trigger mechanism (16) when in the first position, and configured to allow actuation of the trigger mechanism (16) when in the second position.

2. The ignition device (10) according to aspect 1, wherein the ignition device (10) comprises a proximal end and a distal end, wherein the proximal end and distal end define a proximal-distal axis (50).

3. The ignition device (10) according to any preceding aspect, wherein the ignition device (10) comprises a connecting structure (40), more specifically a connecting structure (40) disposed along the proximal-distal axis (50) and in particular a connecting structure (40) connected to the movable pin (14) at its distal end and connected to the trigger mechanism (16) at its proximal end.

4. The ignition device (10) according to aspect 3, wherein the connecting structure (40) is configured to move in proximal direction when the trigger mechanism (16) is actuated.

5. The ignition device (10) according to any preceding aspect, wherein the flame producing assembly (100) is inserted into the receiving portion (12) along an insertion axis.

6. The ignition device (10) according to aspect 5, wherein the insertion axis is disposed substantially parallel to the proximal-distal axis (50) when the receiving portion (12) is in the ignition position.

7. The ignition device (10) according to aspect 5 or 6, wherein the insertion axis is disposed substantially perpendicular to the proximal-distal axis (50) when the receiving portion (12) is in the receiving position.

8. The ignition device (10) according to any preceding aspect, wherein the flame producing assembly (100) comprises an ignition mechanism (112), wherein the ignition mechanism (112) comprises an actuation surface (114), in particular an actuation surface (114) disposed substantially perpendicular to the proximal-distal axis (50), wherein the ignition mechanism (112) is configured to ignite the flame producing assembly (100) upon actuation of the actuation surface (114).

9. The ignition device (10) according to aspect 8, wherein the actuation surface (114) is actuated by being moved from a distal position towards a proximal position.

10. The ignition device (10) according to any preceding aspect, wherein the flame producing assembly (100) is configured to release gas from a gas valve when the actuation surface (114) is at the proximal position.

11. The ignition device (10) according to any one of aspects 8 to 10, wherein the ignition mechanism (112) comprises a restoring element, in particular a spring, configured to move the actuation surface (114) from its proximal position to its distal position.

12. The ignition device (10) according to any preceding aspect, wherein the trigger mechanism (16) is configured to move from a first position to a second position when actuated.

13. The ignition device (10) according to any preceding aspect, wherein the trigger mechanism (16) comprises a pivot joint (32), wherein the trigger mechanism (16) can pivot around the pivot joint (32) from its first position to its second position.

14. The ignition device (10) according to any preceding aspect, wherein the trigger mechanism (16) comprises a first portion (38), wherein the first portion (38) is configured to move the flame producing assembly (100) towards the distal end when the trigger mechanism (16) is moved, in particular pivoted, to its second position and allow the flame producing assembly (100) to move towards the proximal end when the trigger mechanism (16) is moved, in particular pivoted, to its first position.

15. The ignition device (10) according to aspect 14, wherein the first portion (38) is configured to move towards the distal end when the trigger mechanism (16) is actuated.

16. The ignition device (10) according to any preceding aspect, wherein the trigger mechanism (16) comprises a second portion (36) configured to be actuated, wherein the actuation of the second portion (36) pivots the trigger mechanism (16) from its first position to its second position.

17. The ignition device (10) according to any one of aspects 3 to 16, wherein the connecting structure (40) is configured to move in proximal direction when the trigger mechanism (16) is moved from its first position to its second position and to move in distal direction when the trigger mechanism (16) is moved from its second position to its first position.

18. The ignition device (10) according to aspect 16 or 17, wherein the connecting structure (40) moves towards the proximal end when the trigger mechanism (16) is actuated.

19. The ignition device (10) according to any preceding aspect, wherein trigger mechanism (16) is connected to a trigger restoring element (24), in particular a spring, configured to move the trigger mechanism (16) into its first position.

20. The ignition device (10) according to any preceding aspect, wherein the movable pin (14) is connected to a pin restoring element (22), in particular a spring, configured to move the movable pin (14) into the first position.

21. The ignition device (10) according to any preceding aspect, wherein the movable pin (14) is configured to interlock with the trigger mechanism (16) or the connecting structure (40), when the movable pin (14) is in its first position and to release the trigger mechanism (16) or the connecting structure (40) when the movable pin (14) is in in its second position.

22. The ignition device (10) according to any preceding aspect, wherein the movable pin (14) comprises a protrusion (34), in particular a protrusion (34) configured to press against an ignition mechanism (112) on a flame producing assembly (100) received in the receiving portion (12) when the trigger mechanism (16) is actuated.

23. The ignition device (10) according to any preceding aspect, wherein the movable pin (14) comprises the protrusion (34), wherein the protrusion (34) is in a first position when the movable pin (14) is in its first position and wherein the protrusion (34) is in a second position when the movable pin (14) is in its second position.

24. The ignition device (10) according to aspect 22 or 23, wherein the protrusion (34) is configured to actuate the ignition mechanism (112), when the trigger mechanism (16) is actuated.

25. The ignition device (10) according to any preceding aspect, wherein the ignition device comprises a trigger release mechanism (18), wherein trigger release mechanism (18) is configured to move from a first position to a second position when actuated.

26. The ignition device (10) according to any preceding aspect, wherein the ignition device (10) comprises a trigger release mechanism (18), wherein the trigger release mechanism (18) is configured to move from its first position to its second position when the trigger release mechanism (18) is actuated, and wherein the trigger release mechanism (18) is further configured to block actuation of the trigger mechanism (16) when in its first position, and configured to allow actuation of the trigger mechanism (16) when in its second position.

27. The ignition device (10) according to aspect 26, wherein the trigger release mechanism (18) comprises a pivot joint (30), wherein the trigger release mechanism (18) can pivot around the pivot joint (30) from its first position to its second position.

28. The ignition device (10) according to aspect 26 or 27, wherein the trigger release mechanism (18) is configured to interlock with the trigger mechanism (16) or the connecting structure (40) connected to the trigger mechanism (16), when in the first position and to release the trigger mechanism (16) or the connecting structure (40) when in the second position.

29. The ignition device (10) according to any one of aspects 25 to 28, wherein the trigger release mechanism (18) comprises an elastic material, wherein the trigger release mechanism (18) is configured to move from its second position to its first position due to a restoring force exerted by the elastic material.

30. The ignition device (10) according to any one of aspects 25 to 29, wherein the trigger release mechanism (18) comprises a trigger actuation surface, configured to be actuated by a user 31. The ignition device (10) according to any preceding aspect, wherein the receiving portion (12) is configured to adapt between the receiving position and the ignition position by a pivotable movement.

32. The ignition device (10) according to any preceding aspect, wherein the receiving portion (12) is a sleeve.

33. The ignition device (10) according to any preceding aspect, wherein the receiving portion (12) comprises an opening positioned at its proximal end when in the ignition position.

34. The ignition device (10) according to aspect 33, wherein the trigger mechanism's (16) first portion (38) is positioned distally of the receiving portion's (12) opening.

35. The ignition device (10) according to any one of aspects 25 to 34, wherein the trigger release mechanism (18) comprises a proximal end and a distal end, wherein the proximal end comprises an actuating surface and the distal end is configured to interlock with trigger mechanism (16).

36. The ignition device (10) according to any preceding aspect, wherein the trigger mechanism (16) is positioned towards the proximal end and the movable pin (14) is positioned towards the distal end of the ignition device (10).

37. The ignition device (10) according to any one of aspects 22 to 36, wherein the protrusion (34) extends from the movable pin (14) in proximal direction.

38. The ignition device (10) according to any preceding aspect, wherein the ignition device (10) comprises an ignition device housing, wherein the trigger mechanism (16), receiving portion (12) and/or movable pin (14) are flexibly linked to the ignition device housing.

39. The ignition device (10) according to any one of aspects 3 to 38, wherein the connecting structure (40) comprises an actuating structure (44) or is connected to an actuating structure (44), more specifically wherein the connecting structure (40) comprises or is connected to an actuating structure (44) at its distal end and in particular wherein the actuating structure (44) extends from the connecting structure's (40) distal end substantially orthogonally or orthogonally to the proximal-distal axis (50).

40. The ignition device (10) according to aspect 39, wherein the actuating structure (44) is positioned distally of the ignition mechanism (112), in particular distally of the ignition mechanism (112)'s actuation surface (114), when a flame producing assembly (100) is inserted in the receiving portion (12) and the receiving portion (12) is in the ignition position.

The invention claimed is:

1. An ignition device, comprising:

a receiving portion configured to receive a flame producing assembly comprising a wand, wherein the receiving portion is configured to adapt between a receiving position and an ignition position;

a trigger mechanism configured to ignite the flame producing assembly when actuated; and a movable pin, wherein the movable pin is configured to move from a first position to a second position when the flame producing assembly is inserted into the receiving portion and the receiving portion is moved to the ignition position, and wherein the movable pin is further configured to block actuation of the trigger mechanism when in the first position, and configured to allow actuation of the trigger mechanism when in the second position.

2. The ignition device according to claim 1, wherein the ignition device-comprises a connecting structure disposed along a proximal-distal axis and connected to the movable pin at a distal end of the connecting structure and connected to the trigger mechanism at a proximal end of the connecting structure.

3. The ignition device according to claim 2, wherein the trigger mechanism comprises a first portion, wherein the first portion moves the flame producing assembly towards the distal end when the trigger mechanism is moved to a second position and allows the flame producing assembly to move towards the proximal end when the trigger mechanism is moved to a first position.

4. The ignition device according to claim 3, wherein the first portion moves towards the distal end when the trigger mechanism is actuated.

5. The ignition device according to claim 2, wherein the connecting structure moves towards the proximal end when the trigger mechanism is actuated.

6. The ignition device according to claim 1, wherein the trigger mechanism is connected to a trigger restoring element, wherein the trigger restoring element is configured to move the trigger mechanism into the first position of the trigger mechanism.

7. The ignition device according to claim 1, wherein the movable pin is connected to a pin restoring element wherein the pin restoring element is configured to move the movable pin into the first position of the movable pin.

8. The ignition device according to claim 2, wherein the movable pin is configured to interlock with the trigger mechanism or the connecting structure, when the movable pin is in the first position of the movable pin and to release the trigger mechanism or the connecting structure when the movable pin is in in the second position of the movable pin.

9. The ignition device according to claim 1, wherein the movable pin comprises a protrusion, wherein the protrusion is in a first position when the movable pin is in the first position of the movable pin and wherein the protrusion is in a second position when the movable pin is in the second position of the movable pin.

10. The ignition device according to claim 9, wherein the protrusion is configured to actuate an ignition mechanism, when the trigger mechanism is actuated.

11. The ignition device according to claim 2, wherein the ignition device comprises a trigger release mechanism, wherein the trigger release mechanism is configured to move from a first position to a second position when the trigger release mechanism is actuated and wherein the trigger release mechanism is configured to allow actuation of the trigger mechanism when in the second position of the trigger mechanism.

12. The ignition device according to claim 11, wherein the trigger release mechanism is configured to interlock with the trigger mechanism or the connecting structure connected to the trigger mechanism, when in the first position of trigger mechanism and to release the trigger mechanism or the connecting structure when in the second position of the trigger mechanism.

13. The ignition device according to 11, wherein the trigger release mechanism comprises a proximal end and a distal end, wherein the proximal end comprises an actuating surface and the distal end is configured to interlock with trigger mechanism.

14. The ignition device according to claim 9, wherein the protrusion extends from the movable pin in a proximal direction.

15. The ignition device according to claim 2, wherein the connecting structure comprises an actuating structure or is connected to an actuating structure and wherein the actuating structure extends from the distal end of the connecting structure substantially orthogonally or orthogonally to the proximal-distal axis.

16. The ignition device according to claim 2, further comprising a flame producing assembly inserted into the receiving portion along an insertion axis.

17. The ignition device according to claim 16, wherein the insertion axis is disposed substantially parallel to the proximal-distal axis when the receiving portion is in the ignition position.

18. The ignition device according to claim 16, wherein the insertion axis is disposed substantially perpendicular to the proximal-distal axis when the receiving portion is in the receiving position.

19. The ignition device according to claim 1, wherein the trigger mechanism comprises a pivot joint, wherein the trigger mechanism is configured to pivot around the pivot joint from its first position to its second position.

20. The ignition device according to claim 1, wherein the receiving portion is configured to adapt between the receiving position and the ignition position by a pivotable movement.

* * * * *